US005105187A

United States Patent [19]

Plus et al.

[11] Patent Number: 5,105,187

[45] Date of Patent: Apr. 14, 1992

[54] SHIFT REGISTER FOR ACTIVE MATRIX DISPLAY DEVICES

[75] Inventors: Dora Plus, South Bound Brook; Roger G. Stewart, Neshanic Station, both of N.J.

[73] Assignee: General Electric Company, Princeton, N.J.

[21] Appl. No.: 510,807

[22] Filed: Apr. 18, 1990

[51] Int. Cl.[5] ..... G09G 3/36

[52] U.S. Cl. ..... 340/811; 340/784; 340/800; 340/801

[58] Field of Search ..... 340/718, 719, 784, 811, 340/783, 800, 801, 803, 804, 825.8, 825.86; 350/332, 333

[56] References Cited

U.S. PATENT DOCUMENTS

| | | | |
|---|---|---|---|
| 4,091,377 | 5/1978 | Shimoi | 340/801 |
| 4,180,813 | 12/1979 | Yoneda | 350/333 |
| 4,395,708 | 7/1983 | Lloyd | 340/784 |
| 4,717,244 | 1/1988 | Hilsum et al. | 350/333 |
| 4,724,433 | 2/1988 | Inoue et al. | 340/805 |
| 4,742,346 | 5/1988 | Gillette et al. | 340/793 |
| 4,746,915 | 5/1988 | Sekiya | 340/719 |
| 4,748,444 | 5/1988 | Arai | 340/784 |
| 4,748,510 | 5/1988 | Umezawa | 358/236 |
| 4,766,430 | 8/1988 | Gillette et al. | 340/793 |
| 4,963,860 | 10/1990 | Stewart | 340/784 |

*Primary Examiner*—Ulysses Weldon
*Assistant Examiner*—Jick Chin
*Attorney, Agent, or Firm*—J. S. Tripoli; D. H. Irlbeck; L. L. Hallacher

[57] ABSTRACT

A select line scanner circuit for a display device has a plurality of register stages. The register stages each include first and second register segments and first and second latch circuit means which receive select signals and apply oppositely poled logic signals to the output nodes of the register stages. Voltage boosting means are associated with at lest one of the register stages to assure that the logic signals are applied at the proper levels.

22 Claims, 3 Drawing Sheets

SELECT LINE TO PIXEL
10
22
F1
F2
-5V
+15V
F13
F14
37
29
INPUT
36
INPUTBAR
-5V
C3
33
34
C4
28
44
BOOST2
+15V
+6V
-5V
F15
F17
F19
F21
F22
F20
F18
F16
42
SHIFT2
F3
F4
27
-5V
C1
31
32
C2
26
43
BOOST1
+15V
+6V
-5V
F5
F7
F9
F11
F12
F10
F8
F6
38
INPUT
INPUTBAR
SHIFT1
41
39

FIG. 2 SELECT SCANNER WAVEFORMS

SHIFT REGISTER FOR ACTIVE MATRIX DISPLAY DEVICES

BACKGROUND

This invention relates generally to display devices and particularly to a shift register for the select line circuitry of an active matrix liquid crystal display device.

A liquid crystal display is composed of a matrix of liquid crystal pixels which are arranged vertically in columns and horizontally in rows. When a full color display is desired, and particularly when a gray scale display is needed to display color video, each of the liquid crystal pixels is composed of three elements which individually provide red, green and blue light. In a gray scale video display the individual pixel elements are biased to various voltages to control the brightnesses of the colors provided by each of the elements, and thus all colors can be produced, including flesh tones. The video information is applied to the display pixels by data lines which apply the proper voltage levels to the individual pixel elements within the columns to achieve the desired colors for the various pixels. The full display is produced by sequentially actuating the various horizontal lines using a select scanner circuit so that the display is produced one horizontal line at a time. In an active matrix liquid crystal display, each of the individual pixel elements is associated with a thin film transistor (TFT) which is used to turn the pixel element on and off. The source of the TFT is coupled to the data line over which the video information is supplied, while the gate electrode of the TFT is coupled to the select line which is energized by the select line scanner.

Frequently, the TFTs associated with the individual pixel elements are fabricated using either polysilicon or amorphous silicon technology. Preferably the drive circuitry used to apply the video information to the pixel elements, and the select scanner circuitry used to select the horizontal lines, are fabricated on the same substrate as the pixel elements and simultaneously with the TFTs. Accordingly, when amorphous silicon technology is used the components are fabricated with low mobility unstable enhancement type n-channel transistors. There are several problems associated with fabricating circuitry with this technology. First, the performance of the devices is inherently slow because of the low carrier mobility and also because of the high gate overlap capacitance. Second, there is no circuit voltage gain because of the lack of a stable load device. Third, the threshold voltage of the transistors is unstable even under modest voltage and temperature stress conditions. The threshold voltage instability presents a particularly severe problem with the select line scanners because of the need for much higher output voltages. Typically, these output voltages are 20 volts peak-to-peak rather than 5 volts peak-to-peak as they are for the data line scanners. Conventional NMOS shift register circuits are not adequate to meet either the speed or stability requirements for the select line scanner shift registers. The present invention overcomes these difficulties.

SUMMARY

A select line scanner circuit having M register stages for individually applying select signals to the rows of pixels in a display device having M rows of pixels, each of the register stages includes a first register segment for receiving select signals and providing oppositely poled logic signals to first and second output nodes of the register segment. A first latch circuit is responsive to the first and second output nodes. Voltage boosting means is arranged between the first and second output nodes and the first latch circuit for assuring that the logic signals attain the desired level. A second register segment is responsive to the first and second output nodes and to other select signals for providing additional oppositely poled logic signals to third and fourth output nodes of the second register segment, the third and fourth output nodes apply select signals to the next register stage. A second latch circuit is responsive to the third and fourth output nodes. Additional voltage boosting means is arranged between the third and fourth output nodes and the second latch circuit for assuring that the additional logic signals attain the desired level. Logic signal transfer means are individually responsive to the additional oppositely poled logic signals for alternately applying the additional logic signals to the rows of pixels.

DETAILED DESCRIPTION

Figure 1:
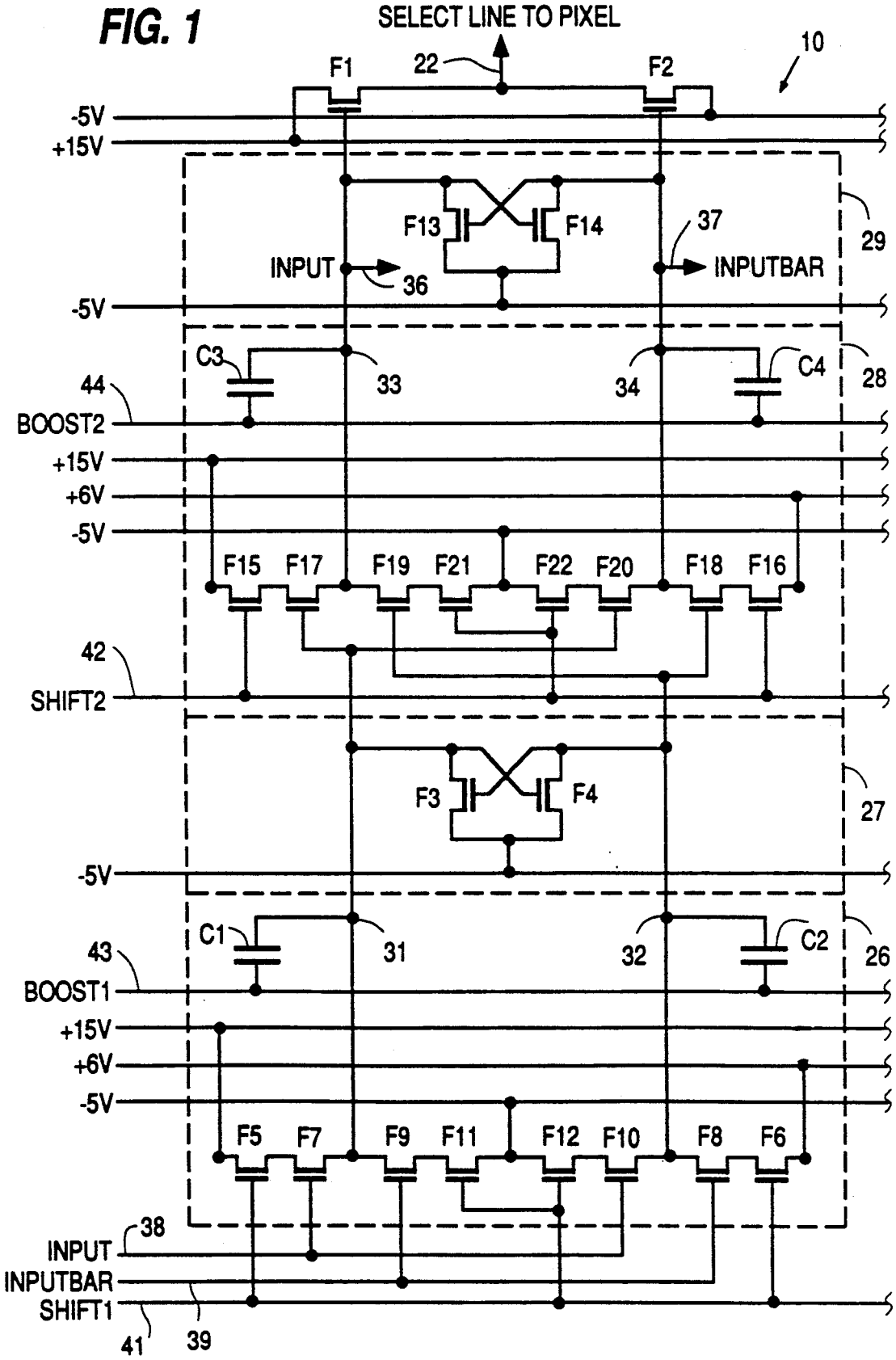
FIG. 1 is a preferred embodiment of a select line scanner for a liquid crystal display device.
Figure 3:
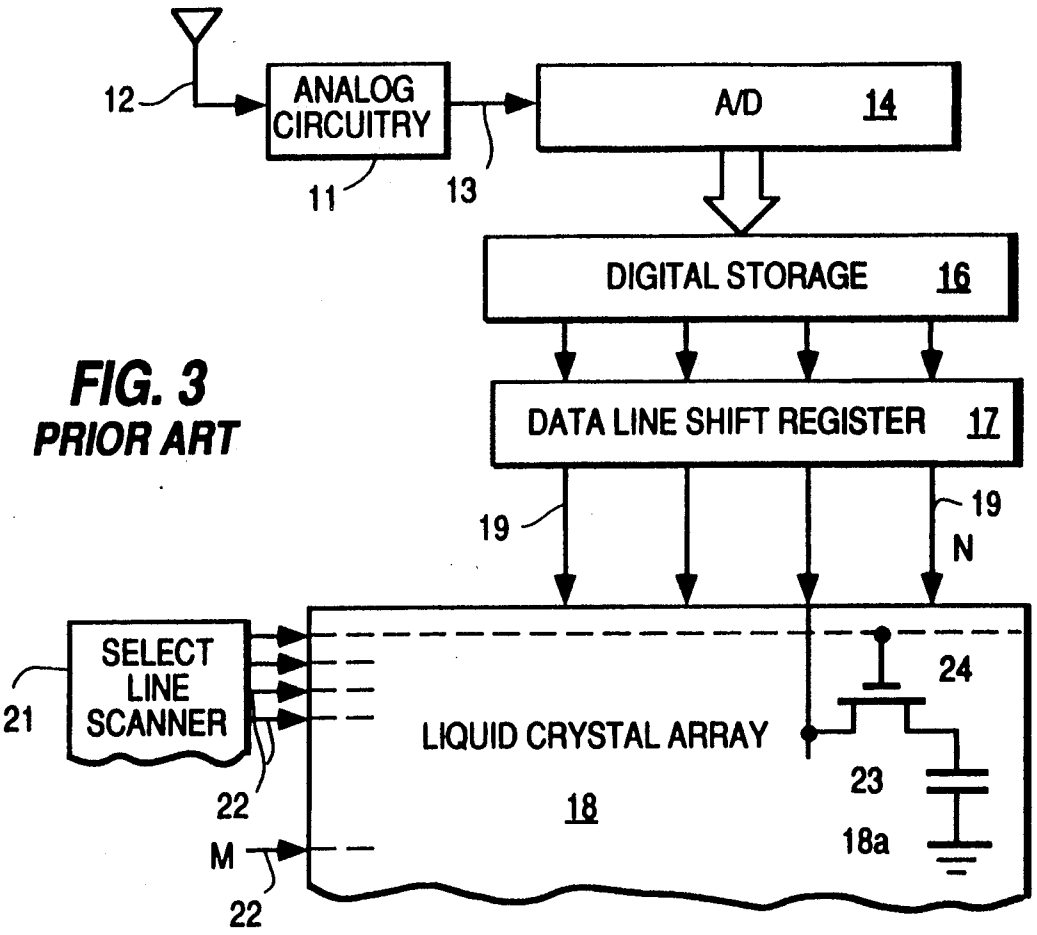
FIG. 3 PRIOR ART
FIG. 3 is a prior art illustration of a liquid crystal display device including the select line scanner and data line shift register shown in simplified form.

FIG. 1 is a preferred embodiment of a select line scanner circuit stage 10, one of which is associated with each of the select lines of a liquid crystal display device. The manner in which the register stage 10 is incorporated into a liquid crystal display device can be understood from the prior art illustration in FIG. 3. In FIG. 3, analog circuitry 11 receives an analog information signal representative of the data to be displayed from an antenna 12. When the incoming signal is a television video signal, the analog circuitry 11 is a standard television receiver of a type well known to those skilled in the art. The analog circuitry 11 provides an analog data bearing signal on a line 13 as an input signal to an analog-to-digital converter (A/D) 14. The digitized video information from A/D 14 is stored in a digital storage device 16 and subsequently transferred to a data line shift register 17. The video signal from analog circuitry 11 is to be displayed on a liquid crystal array 18 which is composed of a large number of pixels, such as liquid crystal 18*a*. The liquid crystals 18*a* are arranged vertically in N columns and horizontally in M rows. Accordingly, the data line shift register 17 includes one data line 19 for each of the N columns of pixels 18*a*. Additionally, a select line scanner 21 includes one select line 22 for each of the M rows of pixels 18*a* within the liquid crystal array 18. Each of the liquid crystal pixels 18*a* within the display is associated with a thin film transistor 23 the gate 24 of which is coupled to one of the select lines 22. The thin film transistors can be amorphous silicon or polysilicon. When color video is to be displayed each pixel contains three of the liquid crystals 18*a*; one red, one green, and one blue. The number of data lines needed is thus tripled.

When a visual display is to be produced on the array 18 all of the data lines 19 are simultaneously provided with the appropriate video information for the various columns of pixels. Simultaneously, one of the select lines 22 is energized so that all the thin film transistors 23 associated with that row are simultaneously energized and the pixel elements are illuminated to the brightnesses determined by the video data on the individual data lines 19. When all the video information for a particular row has been transferred to the pixels within the row the energized select line is turned off and a subsequent line is turned on and the process repeated for that row. With the invention one of the select line scanner circuit stages 10 illustrated in FIG. 1 is provided for each of the select lines 22 associated with the array 18.

In FIG. 1, each register stage 10 includes a first register segment 26, a first latch circuit 27, a second register segment 28 and a second latch circuit 29. The output signals on output nodes 31 and 32 of the first register segment 26 are transferred to output nodes 33 and 34 of the second register segment 28 without any change in the polarity of the signals. The output nodes 33 and 34 of the second register segment 28 directly drive the gates of an output buffer formed by thin film transistors F1 and F2 of one of the select lines 22, again the signals are transferred without a change in polarity. The output nodes 33 and 34 also drive the input and input-bar lines of the immediately succeeding register stage by way of lines 36 and 37. Accordingly, only the first one of the plurality of stages 10 receives control inputs, on input and input-bar lines, from an outside system. The rest of the shift register stages receive data inputs from the immediately preceding register stage. For an active matrix LCD display, the select lines 22 typically require a positive voltage for Logic-I and a negative voltage for Logic-0 (for example +15 V and −5 V) on the gate electrodes of each pixel element transistor.

Figures 2A, 2B, 2C, 2D, 2E:
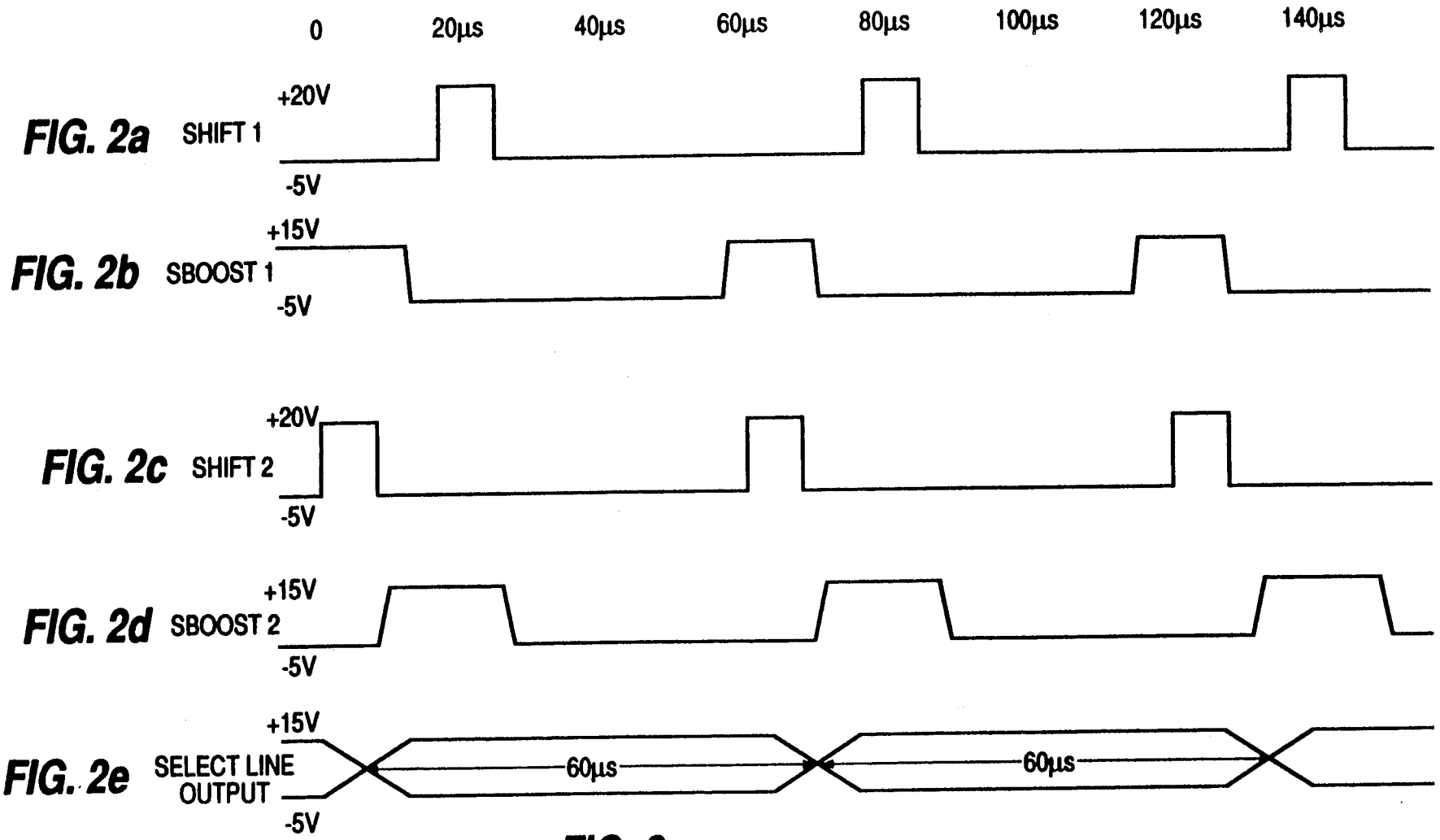
FIGS. 2*a* to 2*e* show the waveforms associated with the preferred embodiment of FIG. 1.

The shift register stage 10 shown in FIG. 1 includes two semi-static latch stages 27 and 29. The latch stage 27 receives control inputs from a pair of differential input signals generated by the immediately previous latch stage and which are available on input line 38 and input-bar line 39 respectively. Similar to typical shift register operation, two out-of-phase non-overlapping clocked pulses (FIGS. 2*a* and 2*c*) on shift line 41 and shift line 42, respectively coordinate and control the timing of data shifting on all shift register stages in the select scanner system.

The first latch 27 consists of two TFT transistors, F3 and F4, and two pull-up load capacitors C1 and C2. The booster capacitors C1 and C2 ensure that the nodes 31 and 32 are brought to the full voltages needed for proper operation. Additional booster capacitors C3 and C4 are associated with nodes 33 and 34 for the same purpose. Transistors F5, F7, F9, F11 are used to transfer the input signal to node 31 and transistors F6, F8, F10, F12 are used to transfer the input-bar signal to node 32 for the first latch 27. The shift 1 signal on line 41 is connected to the gates of transistors F5, F6, F11, F12 and controls the timing of the data transfer from the previous latch stage into this latch stage.

In order to reduce the high voltage stress on the gates of the load transistors, it is necessary to create a voltage level difference for Logic-1 on node 31 and node 32. In the example of the preferred embodiment, +15 V is used on the source of F5 to obtain a +15 V Logic-1 level on node 31; and +6 V is used on the source of F6 to obtain +6 V Logic 1 level on node 32. Because different logic high levels are used, the values of the voltage boosting load capacitors C1 and C2 are scaled to achieve a balanced data transfer into the next latch stage. The Logic-0 voltage level for node 31 and node 32 is the same at −5 V for both nodes and is applied to the sources of transistors F11 and F12 for latch 27, and to transistors F21 and F22 for latch 29.

To describe the circuit operation, assume that latch 27 initially has a Logic-0, (−5 V) on node 31 and a Logic-1, (+6 V) on node 32. Opposite logic input data of +23 V and −5 V on input line 38 and input-bar line 39 respectively are to transferred to nodes 31 and 32. A boost line 43 is at −5 V. Then shift 1 line 41 is brought to +20 V to transfer data from the previous stage. Node 31 and node 32 are charged to about +10 V to +15 V and −5 V during the shift 1 high period. The high voltage typically is reduced by the source follower operation of the transistors. After completion of the data transfer, shift 1 line 41 returns to −5 V. Then boost 1 line 43 is brought from −5 V to +15 V. This boost signal couples through capacitors C1 and C2 and combining with regenerative latching action of transistors F3 and F4 amplifies the differential signal on nodes 31 and 32. The logic stages on node 31 and node 32 are charged to be +24 V, logic 1, and −5 V, logic 0, respectively. The second latch stage 29 functions in the same manner as latch stage 27 except the output nodes 33 and 34 are used to drive the large select line buffer devices F1 and F2, which in turn drive a heavily loaded select line 22. Note that the boost 1 line 43 and a boost line 44 are only kept high only during the actual data transfer period after which they are returned to their low state in order to minimize voltage stress in the transistors. Also the boost voltage must be designed such that the voltage increase induced at the boosted node is always greater than the voltage loss due to the source follower action in the data transfer circuit formed by transistor F5, 7, 9, 11, 12, 10, 8, 6, for latch 27, or F15, 17, 19, 21, 22, 20, 18, 16 for latch 29 in order for the circuit to maintain greater than unity voltage gain under worst case conditions.

To obtain the most efficient operation of this select scanner, coordinated waveforms on all control signals as shown in FIG. 2 are required. The amount of time during which a high voltage is applied to the gates of the transfer transistor is reduced to 25% of that needed for prior art circuits. The circuit is also advantageous because it shows only 10 usec out of the 65 usec available line time is used for select or deselect transitions; and 15 V/−5 V full logic levels are obtained.

The inventive circuit is advantageous because it achieves high speed performance using non-inverting differential input latches, different power supply voltages on each side of the latch circuits, booster capacitors as pull-up loads, and slow ramping of booster signals with simultaneous positive feedback coupling for maximizing regenerative gains. The circuit technique has excellent tolerance to variations in transistor characteristics as needed to cope with the device threshold instability problems.

What is claimed is:

1. A select line scanner-circuit having a plurality of register stages for individually applying select signals to the rows of pixels in a display device having a plurality of rows of pixels, each of said register stages comprising:

a first register segment for receiving select signals and providing oppositely poled logic signals to first and second output nodes of said register segment;

first latch circuit means responsive to said first and second output nodes;

a second register segment responsive to said first and second output nodes and to other select signals for providing additional oppositely poled logic signals to third and fourth output nodes of said second register segment, said third and fourth output nodes applying select signals to the next register stage;

second latch circuit means responsive to said third and fourth output nodes voltage boosting means arranged between at least two of said output nodes for assuring that said additional logic signals attain the desired level;

logic signal transfer means individually responsive to said additional oppositely poled logic signals for alternately applying said additional logic signals to said rows of pixels.

2. The select line scanner circuit of claim 1 wherein said first and second register segments and said first and second latch circuit means are amorphous silicon solid state devices.

3. The select line scanner circuit of claim 1 wherein said first and second register segments and said first and second latch circuit means are polysilicon solid state devices.

4. The select line scanner circuit of claim 2 wherein said voltage boosting means are capacitors.

5. The select line scanner circuit of claim 1 wherein said voltage boosting means are capacitors.

6. The select line scanner circuit of claim 1 wherein said voltage boosting means are arranged between said first and second output nodes and between said third and fourth output nodes.

7. The select line scanner circuit of claim 1 wherein said oppositely poled logic signals have unequal voltage values.

8. The select line scanner circuit of claim 7 wherein said voltage boosting means are arranged between said first and second output nodes and between said third and fourth output nodes.

9. A select line scanner circuit having a plurality of stages for transferring select signals to pixels in an imaging device, each of said stages being responsive to select signals from the preceding stage, each of said stages including a positive and a negative output node for respectively supplying positive and negative select signals to the succeeding stage, each of said stages also including:

a first input section having positive and negative output terminals, said first input section receiving said select signals and selectively producing first positive and negative logic signals on said positive and negative output terminals in accordance with said select signals;

a second input section including said positive and negative output nodes, said second input section receiving additional select signals and selectively producing said positive and negative output signals on said positive and negative output nodes in accordance with said additional select signals;

first signal selection means for selectively applying said first positive and negative logic signals to said positive and negative output terminals respectively;

first voltage boosting means arranged between said output terminals and said first signal selection means for raising said output terminals to the desired voltage levels;

second signal selection means responsive to said positive and negative output terminals for selectively applying said positive and negative output signals to said positive and negative output nodes; and second voltage boosting means arranged between said output nodes and said second signal selection means for raising said output nodes to the desired voltage levels.

10. The select line scanner circuit of claim 9 wherein said first and second voltage boosting means are voltage storage means.

11. The select line scanner circuit of claim 10 wherein said first and second signal selection means are latch circuits.

12. The select line scanner circuit of claim 11 wherein said voltage storage means are capacitors

13. The select line scanner circuit of claim 12 wherein said first and second input sections and said first and second signal selection means are solid state devices.

14. The select line scanner circuit of claim 13 wherein said solid state devices are amorphous silicon devices.

15. The select line scanner circuit of claim 13 wherein said solid state devices are polysilicon devices.

16. The select line scanner circuit of claim 10 wherein said first and second input sections and said first and second signal selection means are solid state devices.

17. The select line scanner circuit of claim 16 wherein said solid state devices are amorphous silicon devices

18. The select line scanner circuit of claim 9 wherein said shift register provides control signals to a liquid crystal display device.

19. A select line scanner-circuit having a plurality of register stages, each of said register stages comprising:

a first register segment for receiving select signals and providing oppositely poled logic signals to first and second output nodes of said register segment;

first latch circuit means responsive to said first and second output nodes;

a second register segment responsive to said first and second output nodes and to other select signals for providing additional oppositely poled logic signals to third and fourth output nodes of said second register segment, said third and fourth output nodes applying select signals to the next register stage;

second latch circuit means responsive to said third and fourth output nodes voltage boosting means arranged between at least two of said output nodes for assuring that said additional logic signals attain the desired level; and logic signal transfer means individually responsive to said additional oppositely poled logic signals for alternately applying said additional logic signals to said rows of pixels.

20. The select line scanner circuit of claim 19 wherein said oppositely poled logic signals have unequal voltage values.

21. The select line scanner circuit of claim 20 wherein said voltage boosting means are arranged between said first and second output nodes and between said third and fourth output nodes.

22. The select line scanner circuit of claim 19 wherein said voltage boosting means are arranged between said first and second output nodes and between said third and fourth output nodes.

* * * * *